US006469679B2

(12) United States Patent
Yoshida et al.

(10) Patent No.: US 6,469,679 B2
(45) Date of Patent: Oct. 22, 2002

(54) ANTENNA INSTALLATION DEVICE AND SATELLITE RADIO FREQUENCY RECEIVER ANTENNA DEVICE

(75) Inventors: Yoshikazu Yoshida, Tokyo; Katsunori Honma, Chiba; Shuichi Wada, Tokyo, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/854,773

(22) Filed: May 14, 2001

(65) Prior Publication Data

US 2002/0003504 A1 Jan. 10, 2002

(30) Foreign Application Priority Data

May 15, 2000 (JP) ..... 2000-141630

(51) Int. Cl.[7] ..... H01Q 1/12
(52) U.S. Cl. ..... 343/892
(58) Field of Search ..... 343/878, 882, 343/840, 874, 890, 892

(56) References Cited

U.S. PATENT DOCUMENTS 5,926,151 A * 7/1999 Hagiwara et al. ..... 343/757
6,031,508 A * 2/2000 Ishizuka et al. ..... 343/878
6,262,691 B1 * 7/2001 Austin et al. ..... 343/878
6,283,425 B1 * 9/2001 Liljevik ..... 248/218.4

* cited by examiner

*Primary Examiner*—Tan Ho
(74) *Attorney, Agent, or Firm*—Frommer Lawrence & Haug LLP; William S. Frommer; Matthew K. Ryan

(57) ABSTRACT

A satellite receiver antenna device is capable of being installed on different types of verandas. A longitudinal side of the first clamp member and a second clamp member grip the concrete wall of the veranda and the receiver antenna is clamped to the concrete wall by applying the lever principle utilizing a plurality of nuts, and by a plurality of bolts inserted in a plurality of through-holes at positions separated lengthwise along the other side of the first and second clamp members. The lengthwise center section on the first clamp member and second clamp member grip the lattice bars of lattice type verandas, and the receiver antenna is clamped to the lattice section by a plurality of nuts and by a plurality of bolts inserted in the through-holes at positions lengthwise on the first clamp member and second clamp member on both sides of the gripped lattice bars.

7 Claims, 6 Drawing Sheets

ANTENNA INSTALLATION DEVICE AND SATELLITE RADIO FREQUENCY RECEIVER ANTENNA DEVICE

BACKGROUND OF THE INVENTION

1. Field of the Invention

The present invention relates to an antenna installation device ideal for example for satellite broadcast receiver antennas and for satellite radio frequency receiver antennas.

2. Description of the Related Art

A satellite broadcast receiver antenna is necessary for directly receiving radio frequency waves from satellites and since antenna installation is simple, antennas are in many cases installed outdoors on a veranda. However, the structure many consist of many diverse types such as the concrete wall type and lattice type, etc. A receiver antenna device sold with a veranda installation section for example may sometimes be impossible to install on the veranda due to the structure of the antenna installation section.

The receive antenna unit and the antenna installation unit of the related unit are therefore in many cases sold separately. When sold separately and the receive antenna is to be installed on the veranda, antenna installation hardware serving as the antenna installation device that matches the structure of the veranda is first purchased, installed on the veranda, and then the receive antenna unit is installed in the antenna installation hardware.

An example of antenna installation hardware 10 of the related art when installing on a lattice type veranda is shown in FIG. 1. The antenna installation hardware 10 comprises a first clamp plate 12 installed with an antenna support pipe 11, a second clamp plate 13 to support the mounting surface for installation and the first clamp plate 12 and also to clamp the antenna installation hardware 10 to the surface for installation, a plurality of bolts 14 and a plurality of nuts 15.

Through-holes (not shown in the drawing) are drilled two each to allow the bolts 14 to pass through at positions matching both longitudinal ends of the first and second clamp plates 12 and 13.

The first and second clamp plates 12 and 13 of the antenna installation hardware 10 as shown in FIG. 2, enclose the lattice (or grate) section of the lattice type veranda 16, and the antenna installation hardware 10 is clamped to the lattice type veranda by mounting the bolts 14 through the through-holes formed respectively in the first and second clamp plates 12 and 13, and tightening the nuts 15.

After being clamped, a satellite receiver parabolic antenna 20 is clamped to the antenna support pipe 11 of the antenna installation hardware 10 and the antenna installation is then complete. The antenna 20 comprises a parabolic reflector plate 21, and a converter 22 to input radio frequency waves collected by a parabolic reflector plate 21 and down-convert signals of a specified frequency band.

Recently, verandas made of concrete are increasing due to the need for privacy, however the previously described antenna installation 10 cannot be installed on verandas of this structure. In such cases, the antenna installation hardware 30 as shown in FIG. 3 is utilized.

The antenna installation hardware 30 comprises a first clamp plate 32 installed with an antenna support pipe 31, a second clamp plate 33 to support the surface for installation (wall, veranda, etc.) and the first clamp plate 32 and also to clamp the antenna installation hardware 33 to the surface for installation, and a link arm 34.

The link arm 34 comprises an arm telescoping mechanism 35. The arm telescoping mechanism 35 elongates and contracts by the rotation of a screw (not shown in the drawing).

When using the antenna installation hardware 30 to install onto the upper section of a concrete wall type veranda, the hand rail 37 on the upper part of the concrete wall 36 is straddled by the link arm 34 as shown in FIG. 4, and the concrete wall 36 is enclosed (or squeezed) by the first clamp plate 32 and second clamp plate 33. The screw of the telescoping mechanism 35 is then rotated to make the first clamp plate 32 and second clamp plate 33 securely grip the concrete wall 36 and clamp the antenna installation hardware 30.

After clamping the antenna installation hardware 30, satellite receiver parabolic antenna 20 is clamped to the antenna support pipe 31 of antenna installation hardware 30 and the installation is complete.

The satellite receiver parabolic antenna and the antenna installation hardware were therefore sold separately as previously mentioned and when installing the satellite receiver parabolic antenna onto a veranda, purchasing antenna installation hardware matching the structure of the veranda was necessary.

So when the antenna installation position was changed or the installation conditions changed due to the user moving to a different location, the need to purchase new antenna installation hardware arose thus imposing a greater economic burden on the user.

Also, an insertion pipe for example, had to be made in order to allow the antenna piece to match the various types of antenna installation hardware, and the insertion pipe on the other hand, had to be inserted in the support pipe and then installed onto the antenna piece, creating restrictions on the structure and making it difficult to produce an antenna device with a lower cost.

Further, when installing the antenna, the antenna installation hardware first had to be clamped onto the veranda and then the antenna piece installed, causing the disadvantages that there were many job steps (processes) in the installation and the difficulty of the installation job increased.

In view of the above mentioned problems with the related art, the present invention has the object of providing an antenna installation device and a satellite radio frequency receiver antenna capable of being installed even on lattice type verandas and concrete wall type verandas and having excellent cost effectiveness.

SUMMARY OF THE INVENTION

In order to achieve the above objects, the antenna installation device of the present invention comprises an antenna installation member, a first clamping piece member installed with the antenna installation member, a second clamping piece member for clamping the surface for installation along with the first clamping piece member, a plurality of bolts, and a plurality of nuts: and the first and second clamping piece members contain a plurality of through-holes or slot holes for the bolts to pass through at opposite mutually complementary positions of these two longitudinal clamping piece members, and the antenna installation device is characterized by a first clamp state for clamping the surface for installation by enclosing the surface for installation with one longitudinal side of the first and the second clamping piece members, and a plurality of bolts pass through-a plurality of holes at separated positions along the longitudinal direction on the other side of the first and second clamping members and the surface for installation is clamped by means of a plurality of nuts; and a second clamp state for enclosing the surface for installation with the center longitudinal section of the first and second clamping piece members, and a plurality of bolts pass through through-holes at positions longitudinally along the first and second clamping pieces on both sides of the surface for installation, and the surface for installation is clamped by means of a plurality of nuts.

In the antenna installation device of the invention configured as described above, an antenna installation device can be clamped to the mounting surface for installation constituted by the upper part of the concrete type veranda by means of the first clamp state. The antenna installation device can be clamped by the second clamp state to the mounting surface for installation constituted by the lattice section of a lattice veranda by means of the second clamp state. The antenna installation device of this invention can therefore be clamped to many types of diverse verandas.

DETAILED DESCRIPTION OF THE PREFERRED EMBODIMENTS

The embodiments of the invention are next described while referring to the accompanying drawings. The embodiments described hereafter, utilize a satellite radio frequency receiver antenna device containing the antenna installation device.

Figure 1:
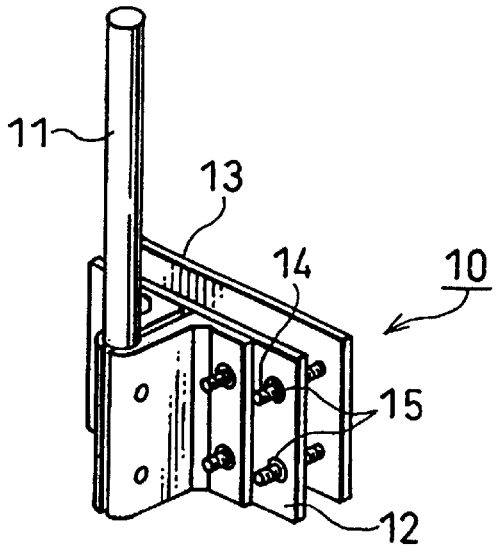
FIG.1 (RELATED ART)
FIG. 1 is a drawing showing typical antenna installation hardware of the related art.
Figure 2:
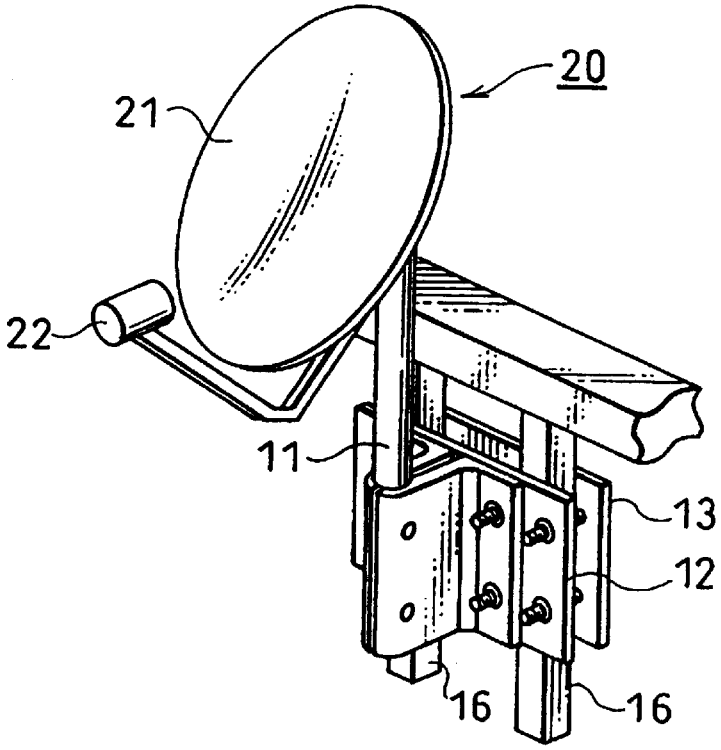
FIG.2 (RELATED ART)
FIG. 2 is drawing showing another embodiment utilizing the antenna installation hardware of FIG. 1.
Figure 3:
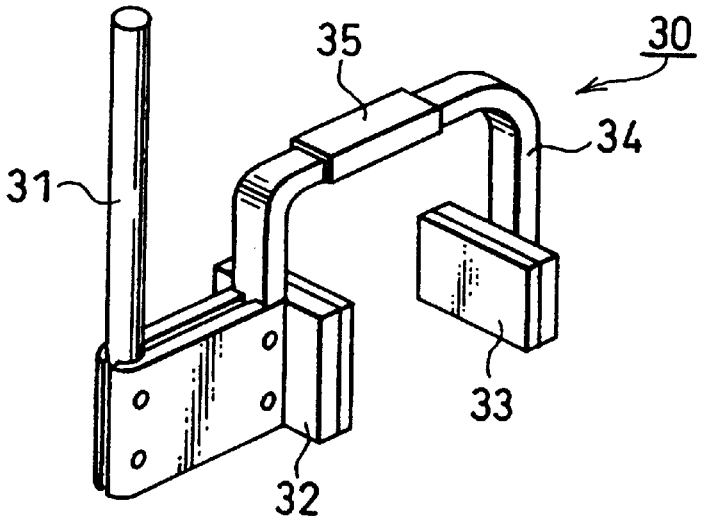
FIG.3 (RELATED ART)
FIG. 3 is a drawing showing another example of the antenna installation hardware of the related art.
Figure 4:
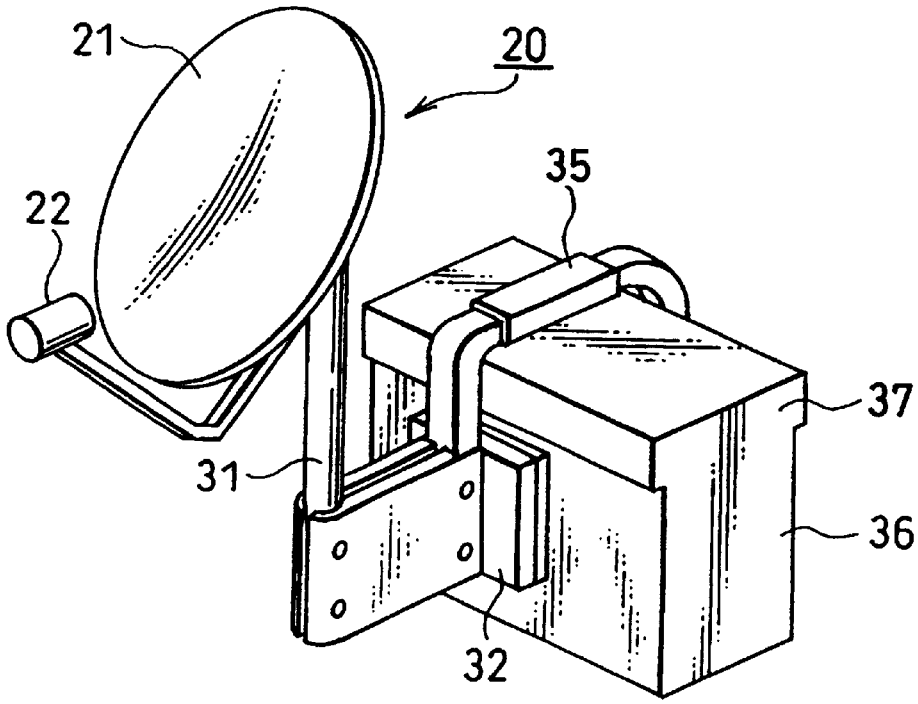
FIG.4 (RELATED ART)
FIG. 4 is a drawing showing an installation utilizing the antenna installation hardware of FIG. 3.
Figure 5:
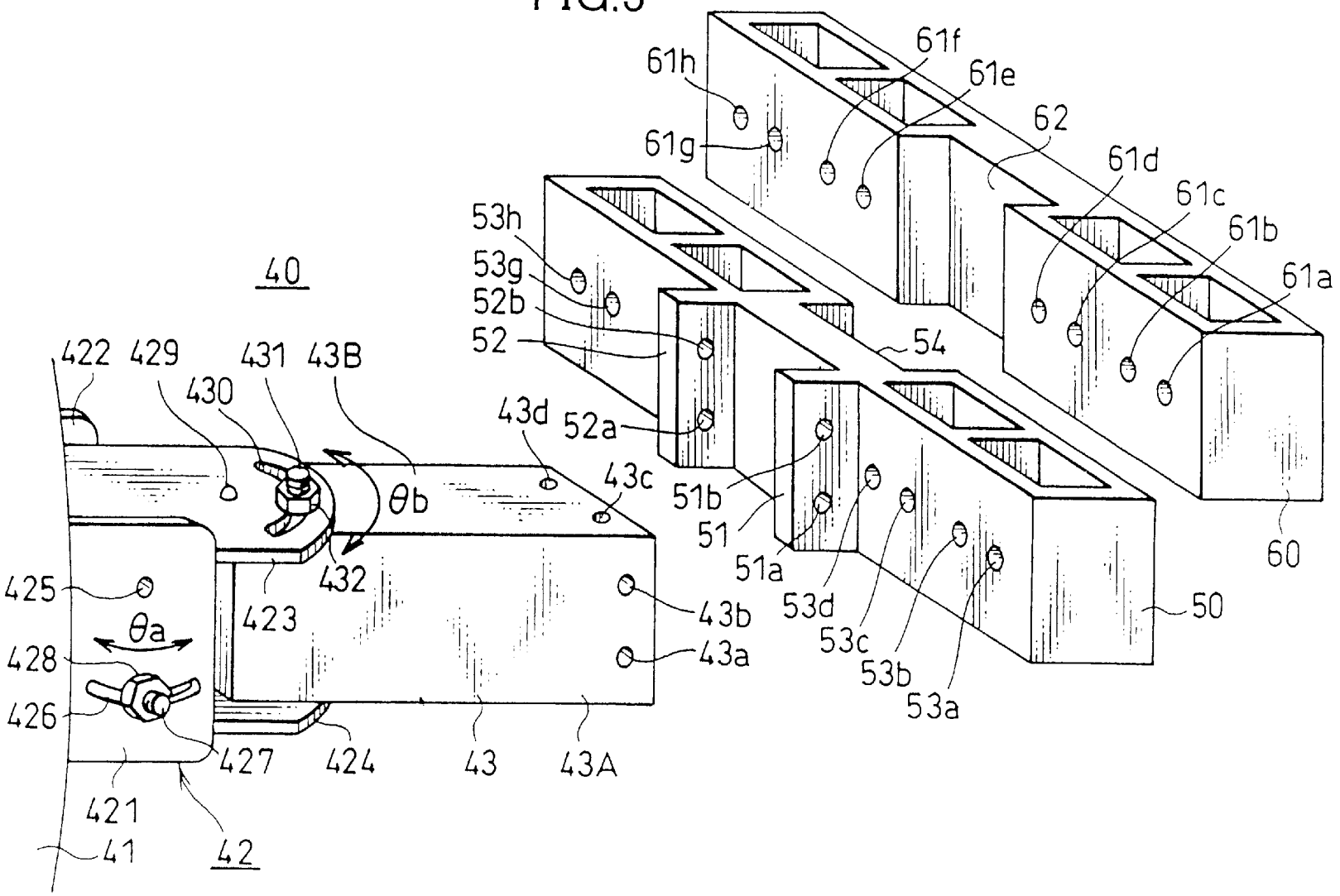
FIG. 5 a drawing showing a section of the antenna installation device for the embodiment of the satellite radio frequency receiver antenna device of the invention.

FIG. 5 is a drawing showing mainly the antenna installation device section of the satellite broadcast receiver of the embodiment. The antenna installation device section as shown in FIG. 5, is broadly grouped into an antenna installation section 40, a first clamp member 50, and a second clamp member 60. The antenna installation section 40, the first clamp member 50, and the second clamp member 60 are comprised for example of a metal such as aluminum.

The antenna installation section 40 is first explained.

A parabolic reflector plate 41 is installed onto an antenna installation member 43 by way of direction and angle adjuster 42. Though not shown in the drawing, the down-converter to input the radio waves collected by the parabolic reflector plate 41 and down-convert signals of a specified frequency band is the same as in the related art.

The antenna installation member 43 comprises a material such as aluminum in a hollow, square-shaped block. The parabolic reflector plate 41 and the converter are fastened to one end of the member 43 by way of the direction and angle adjuster 42. In the case of this embodiment, the antenna installation member 43 has a rectangular shaped cross section.

The direction and angle adjuster 42 comprises an azimuth angle adjuster section and an angle-of-elevation adjuster section. The angle-of-elevation section has a box shape open on the left side and comprises two parallel plates 421, 422. The angle-of-elevation section is fastened to the parabolic reflector plate 41.

The two plates 421, 422 of the angle-of-elevation section are installed to rotate by means of a rotating shaft 425, in the direction of the arrow θ a on the two parallel plates 423, 424 contained in the direction and angle adjuster section. The direction of the rotating shaft 425 is parallel to the two plates 423, 424 of the direction and angle adjuster section.

An arc-shaped slot 426 is drilled in the plates 421, 422 to guide the rotation, and a bolt 427 is fastened to the direction and angle adjuster section and fits into the slot 426. Therefore, the angle-of-elevation of the antenna reflector plate 41 can be adjusted within an angular range according to the length of the slot 426. When the angle-of-elevation adjustment is complete, the antenna reflector plate can be fixed at that azimuth position by screw-tightening the nut 428 on the bolt 427.

The direction and angle adjuster section is structured to be rotatable in the direction of the arrow θb by means of a rotating shaft 429 passing through both sides of the two plates 423, 424 mutually facing the antenna installation member 43. An arc-shaped slot 430 is drilled in the plates 423, 424 to guide the rotation, and a bolt 431 is inserted into the slot 430 to fasten the antenna installation section 43. The directional angle of the antenna reflector plate 41 is therefore adjustable within an angular range according to the length of the slot 430. When finished making the adjustment, the bearing angle is fixed in that position by tightening the nut 42 screwed onto the bolt 41.

The other end of the antenna installation member 43 is attached to the first clamp member 50. The other end of the antenna installation member 43 therefore is drilled with two through-holes on each of the four surfaces to allow bolts to pass through. FIG. 5 shows the two through-holes 43*a*, 43*b* drilled in the side surface 43A intersecting the bearing adjustment angle shown by the arrow θb, and the two through-holes 43*c*, 43*d* drilled in the side surface 43B along the bearing adjustment angle shown by the arrow θb, however the side surfaces facing the side surfaces 43A, 43B are also formed with through-holes in the same way.

The first clamp member 50 and the second clamp member 60 are plate-shaped members. These first and second clamp members 50 and 60 enclose (or grip) the concrete wall and lattice of the veranda to be installed with the antenna and clamp the surface for installation by means of a plurality of bolts and nuts as described later on. Therefore a plurality of holes are drilled at mutually corresponding longitudinal positions along the first and second clamp members 50 and 60 to allow insertion of the bolts and respectively consist of the eight through-holes 53*a*, 53*b*, 53*c*, 53*d*, 53*e*, 53*f*, 53*g*, 53*h* and 61*a*, 61*b*, 61*c*, 61*d*, 61*e*, 61*f*, 61*g* 61*h*.

Installation pieces 51 and 52 are installed at approximately the center position in the lengthwise direction of the first clamp member 50. The eight through-holes 53*a*, 53*b*, 53*c*, 53*d*, 53*e*, 53*f*, 53*g*, 53*h* are respectively formed four each, on both sides of the install pieces 51 and 52. The through-holes 61*a*, 61*b*, 61*c*, 61*d*, 61*e*, 61*f*, 61*g* 61*h* of the second clamp member 60 are therefore formed at positions respectively corresponding to the through-holes 53*a,* 53*b,* 53*c,* 53*d,* 53*e,* 53*f,* 53*g,* 53*h.*

The installation pieces 51 and 52 of the first clamp member 50 are formed separated by a distance equal to the width of the side surfaces of the antenna installation member 43. The through-holes 51*a,* 51*b* and the through-holes 52*a,* 52*b* are formed two holes each on the installation pieces 51 and 52 and correspond to the holes on the side surface of the antenna installation member 43.

In this case, the antenna installation member 43 is a square rod with a rectangular shaped cross section so, in order that the installation piece 51 through-holes 51*a,* 51*b* can be made to align with the through-holes 43*a* and 43*b* of the side surface 43A, the center axis of the square rod is rotated 90 degrees on the center and an installation state of the first clamp member 50 is found that allows matching the installation piece 51 through-holes 51*a,* 51*b* with the through-holes 43*a* and 43*b* of the side surface 43A.

The concave steps 54 and 62 are formed in the approximate center in the longitudinal direction on surfaces facing mutually opposite each other on the first and second clamp members 50 and 60.

The process for installing the satellite broadcast receiver antenna device containing the above described antenna installation device for lattice type verandas and concrete type verandas is described next.

[Installing Onto Lattice Type Verandas]

Figure 6:
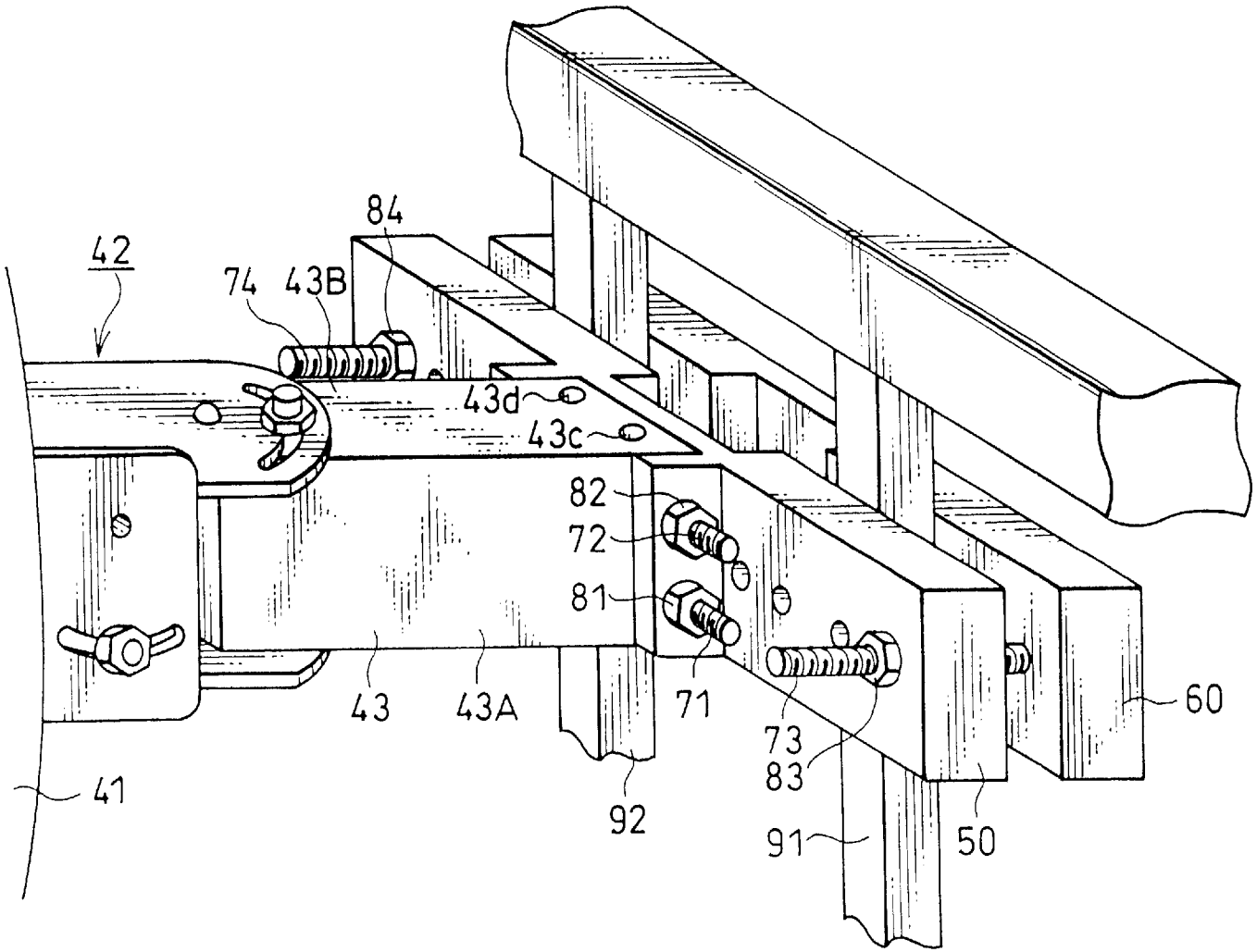
FIG. 6 is a drawing showing an installation of the satellite radio frequency receiver antenna device of the embodiment.

FIG. 6 shows the satellite broadcast receiver antenna device of this embodiment installed onto a lattice type veranda.

At this time, as shown in FIG. 6, the through-holes 43*a* and 43*b* of the side surface 43A are aligned with the installation piece 51 through-holes 51*a,* 51*b.* The bolts 71 and 72 are inserted into these through-holes and the nuts 81 and 82 are mounted on and tightened to these bolts 71, 72 to clamp the antenna installation member 43 to the first clamp member 50.

The first clamp member 50 and the second clamp member 60 set longitudinally and horizontally, then enclose and grip the lattice bars 91, 92 of the lattice type veranda. The bolts 73 and 74 are inserted in the through-holes in appropriate locations longitudinally on the first clamp member 50 and the second clamp member 60 and in the example of FIG. 6, through both ends of the through-holes 53*a,* 61*a,* and 53*h,* 61*h* and by then mounting and tightening the nuts 83, 84 to these bolts 73, 74, the entire antenna unit is clamped to the lattice bars 91 and 92.

The example in FIG. 6 showed the entire antenna unit clamped at two locations enclosing the two lattice bars 91, 92 by means of the positions of the through-holes 53*a,* 61*a* and through-holes 53*h* and 61*h,* however the entire antenna unit may also be clamped by the through-holes 53*c,* 61*c,* and through-holes 53*f,* 61*f,* or the through-holes 53*d,* 61*d,* and through-holes 53*e,* 61*e* positions at the locations between the two lattice bars 91, 92.

After the above clamping is complete, the azimuth angle and angle-of-elevation are adjusted by means of the direction and angle adjuster 42, the parabolic reflector plate 41 is aligned to the correct bearing of the satellite, and the installation is now complete.

[Installation Onto a Wall Type Veranda]

Figure 7:
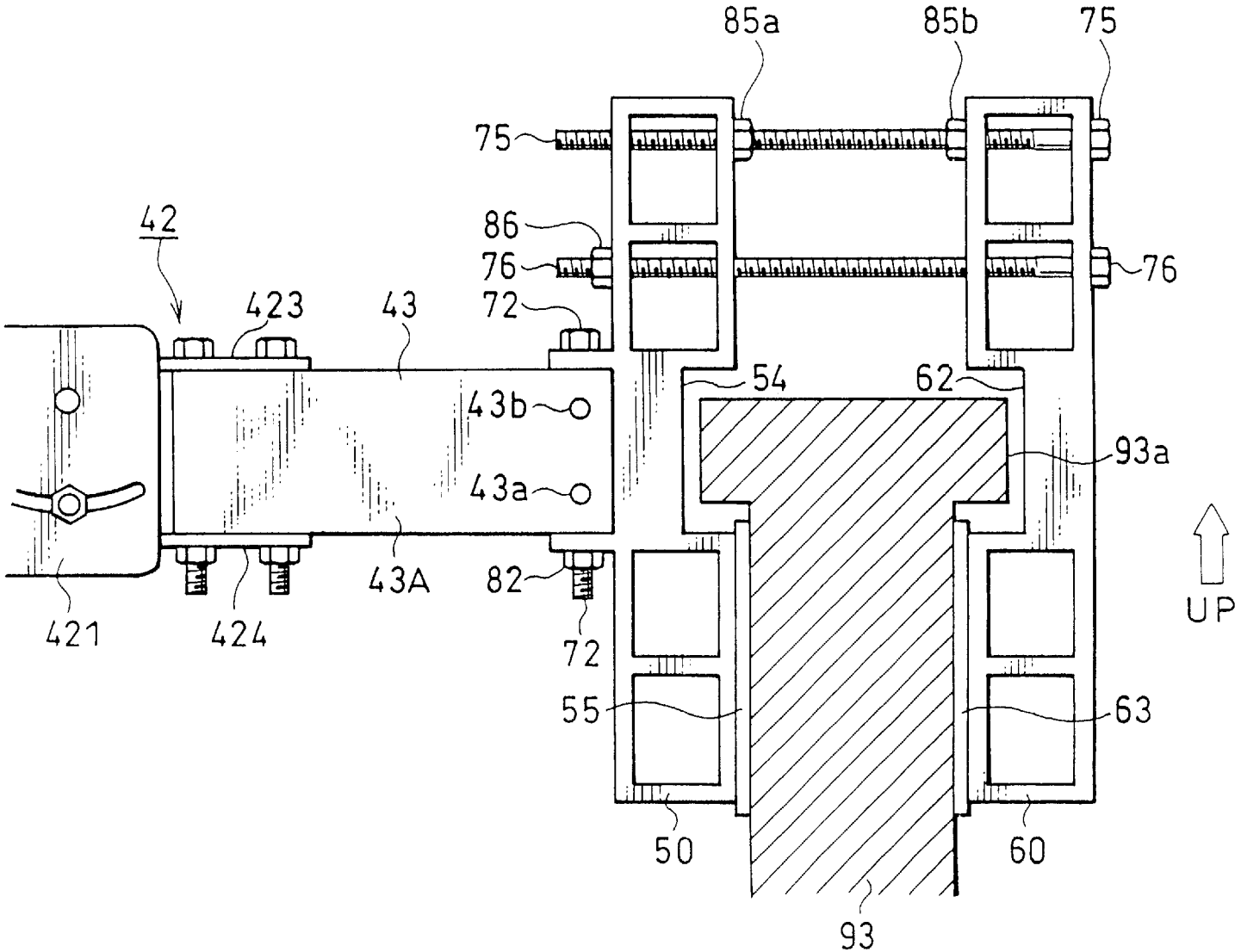
FIG. 7 is a drawing showing another installation of the satellite radio frequency receiver antenna device of the embodiment.

FIG. 7 shows the satellite broadcast receiver antenna device of this embodiment installed onto a wall type veranda.

At this time, as shown in FIG. 7, the through-holes 43*c* and 43*d* of the side surface 43B are aligned with the installation piece 51 through-holes 51*a,* 51*b.* The bolts 71 and 72 are inserted into these through-holes and the nuts 81 and 82 are mounted on and tightened to these bolts 71, 72 to clamp the antenna installation member 43 to the first clamp member 50.

In other words, when installed onto this (concrete) wall-type veranda, unlike the previously described lattice type veranda, the antenna installation member 43 is rotated 90 degrees on the center axis of the square rod and installed onto the first clamp member 50.

The first and second clamp members 50 and 60 are set so their lengthwise directions face perpendicularly as shown in FIG. 7, grip (and enclose) the concrete wall 93 at one end in their lengthwise direction. The first and second clamp members 50 and 60 are mounted at this time so that the handrail (railing) section 93*a* on the upper part of the concrete veranda fit into the concave steps 54 and 62.

Prior to mounting the first and second clamp members 50 and 60 on the concrete wall 93 as described above, the bolts 75 and 76 are inserted into through-holes at two locations on the other end in the longitudinal direction, on the side opposite the mounting section. In this case, two nuts 85*a,* 85*b* are mounted in the section between the first and second clamp members 50 and 60, on the bolt 75 on the outer side (upper side). A nut 86 is mounted on the tip of the protruding bolt 76 on the inner side (lower side) in the usual manner.

Resilient sheets 55 and 63 of material such as rubber are installed utilizing an adhesive member such as double-sided tape, onto the mounting section of the concrete wall 93 at one end in the lengthwise direction of the first and second clamp members 50 and 60.

Then, after the first and second clamp members 50 and 60 are mounted on the concrete wall 93 as shown in FIG. 7, the position of the nuts 85*a,* 85*b* mounted on the upper side bolt 75 are first of all adjusted. In other words, the nut 85*b* is securely tightened, clamping it to the second clamp member 60 side. The nut 85*a* on the other hand, is positioned where the distance between the first and second clamp members 50 and 60 matches the thickness of the concrete wall 93.

The nut 86 mounted on the tip of the lower side bolt 76 is next tightened. By means of this tightening, a tightening force is applied on the concrete wall 93 by the lever principle, occurring on the other end lengthwise on the first and second clamp members 50 and 60. The satellite radio frequency receiver antenna device of this embodiment can in this way be mounted even onto a veranda made of concrete. In this case, the antenna device can be more securely clamped to the concrete wall 93 by means of the resilient sheets 55 and 63.

After the above clamping is finished, the parabolic reflector plate 41 is aligned to the correct bearing of the satellite by adjusting the angle bearing and angle-of-elevation by means of the direction and angle adjuster 42, and the installation is now complete.

When installing onto a lattice type veranda, the first and second clamp members 50 and 60 are in a state rotated 90 degrees. However as described previously, the antenna installation member 43 is at this time installed onto a first clamp member 50 that is rotated 90 degrees so that the bearing (directional) adjustment can be made by the direction and angle adjuster 42 the same as when installed onto a lattice type veranda.

[Other Installations]

Figure 8:
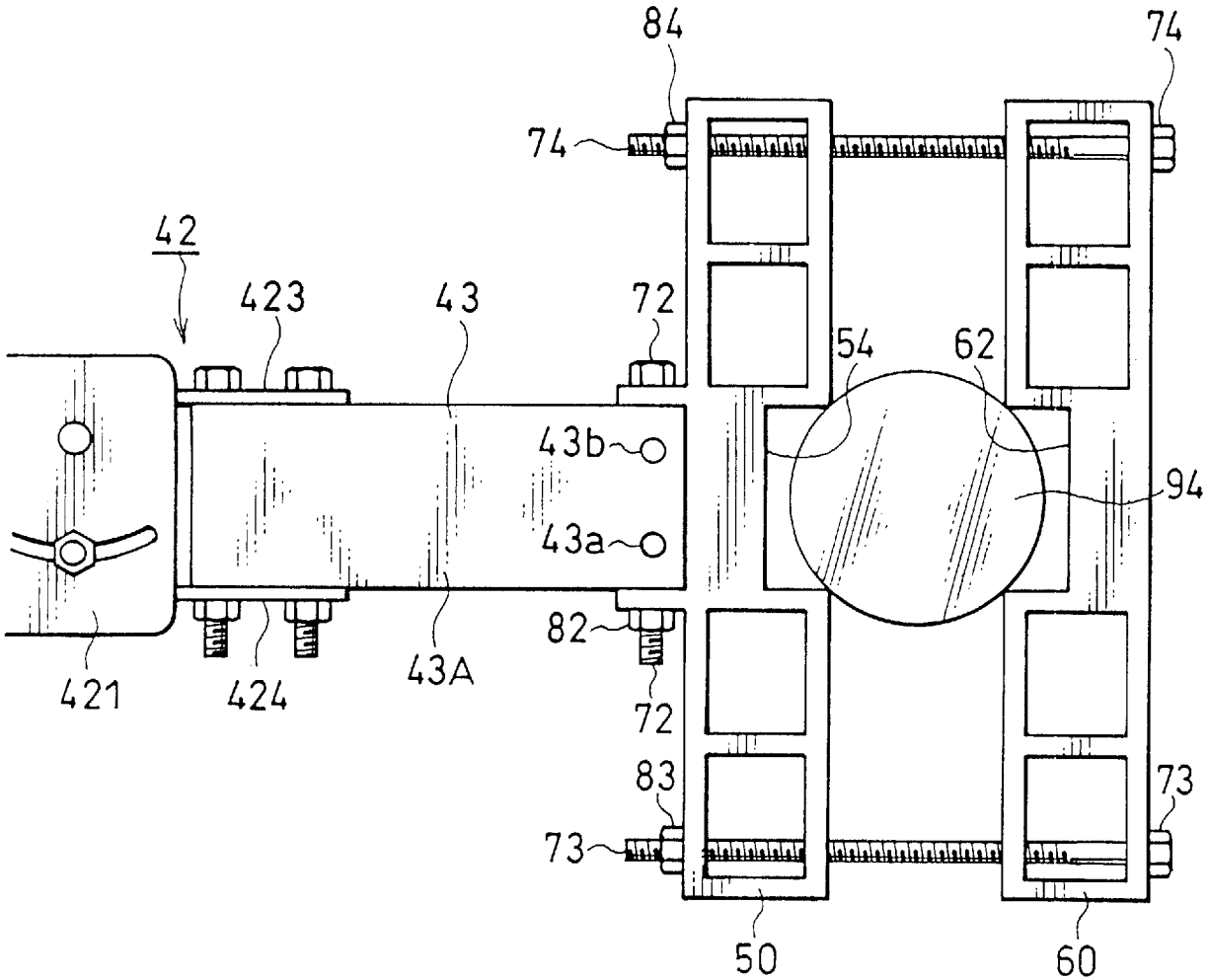
FIG. 8 is a drawing showing another installation of the satellite radio frequency receiver antenna device of the embodiment.

The satellite radio frequency receiver antenna device of this embodiment can also easily be installed on structural sections such as cylindrical structural section 94 as shown in FIG. 8 or square-shaped structural sections by utilizing the concave steps 54 and 62 formed in the center section of the first and second clamp members 50 and 60. In this case, the installation of the first and second clamp members 50 and 60 versus the surface for installation, is the same as the state shown in FIG. 6 and can be clamped by tightening nuts on the bolts inserted in the through-holes gripping the surface for installation at two locations.

In this case, the cylindrical structural section 94 or square-shaped structural sections constituting the surface of installation (mounting surface) may be horizontal or may be vertical. The example in FIG. 8 shows the cylindrical structural section installed horizontally so the coupling of the first clamping member 50 and the antenna installation member 43 is the same as for the installation on the concrete wall of FIG. 7.

[Variations]

The above embodiments were for utilization with satellite radio frequency receiver antenna devices by installing for example, an antenna support pipe as in the related art to the antenna installation member 43, however an antenna installation device comprising a unit separate from the receiver antenna can of course also be utilized. The invention in this case renders the remarkable effect that the antenna installation device can be installed even on lattice type verandas and concrete wall type verandas so that installation on almost all types of verandas is possible with just one antenna installation device.

In the above embodiments, eight through-holes were formed in the clamping member but at least three holes consisting of two holes (for installing on wall type verandas) on the side gripping the installation pieces 51 and 52, and one hole on the other side may also be installed.

Also slotted holes may be formed instead of forming a plurality of through-holes. Slotted holes for example may be formed one each at the positions of the four through-holes, on the side gripping the installation pieces 51, 52 of the installation member 43.

In the invention as described above, a satellite radio frequency receiver antenna device capable of being installed onto nearly all common veranda can be attained. The antenna installation device of the invention further requires no custom installation hardware so that the cost and time required by the installation work can be greatly reduced.

Further, when the installation environment must be changed due for example to moving, then the invention can be flexibly adapted to the new installation environment by changing the antenna installation position.

What is claimed is:

1. An antenna installation device comprising:

an antenna installation member;

a first clamping piece member installed with the antenna installation member;

a second clamping piece member for clamping a mounting surface for installation together with said first clamping piece member;

a plurality of bolts; and a plurality of nuts, said first and second clamping piece members having a plurality of through-holes or slot holes for said bolts to pass through at opposite mutually complementary positions of two longitudinal said clamping piece members, wherein a first clamp state clamps said mounting surface for installation by enclosing said mounting surface for installation with one longitudinal side of said first and the second clamping piece members, and the plurality of bolts pass through a plurality of holes at separated positions along the longitudinal direction on the other side of said first and second clamping members and said mounting surface for installation is clamped by means of the plurality of nuts;

a second clamp state clamps said mounting surface for installation with the center lengthwise section of said first and second clamping piece members, and a plurality of bolts pass through through-holes at positions on both sides of said mounting surface for installation on longitudinal said first and second clamping members, and said mounting surface for installation is clamped by means of said plurality of nuts; and whereby said mounting surface for installation of said first clamp state is a concrete wall of a concrete wall type veranda and said mounting surface for installation of the second clamp state are lattice bars of a lattice type veranda.

2. An antenna installation device according to claim 1, wherein said antenna installation member can be installed clamped in two different states rotated on the center axis at an angle 90 degrees in a direction perpendicular to said first clamp member.

3. An antenna installation device according to claim 1, wherein a concave shape is formed in the center section of said first and second clamping members in the longitudinal direction.

4. An antenna installation device according to claim 1, wherein in said first clamp state, a resilient sheet is inserted between said mounting surface for installation and said first and second clamping members.

5. A satellite radio frequency receiver antenna device having an antenna installation device according to claim 1, wherein an antenna comprising a direction and angle adjuster for receiving radio frequency waves from satellites is installed on said antenna installation member of said antenna installation device.

6. A satellite radio frequency receiver antenna device according to claim 5, wherein said direction and angle adjuster comprises a azimuth angle adjuster section and an angle-of-elevation adjuster section.

7. An antenna installation device for installing an antenna to a mounting surface comprising:

an antenna installation member;

a first clamping piece member installed with the antenna installation member;

a second clamping piece member for clamping a mounting surface for installation together with said first clamping piece member; and wherein said antenna installation member and first and second clamping piece members include means for installing the antenna installation device between a first clamp state, wherein said mounting surface is a concrete wall of a concrete wall type veranda, and a second clamp state, wherein said mounting surface are lattice bars of a lattice type veranda.

* * * * *